US007567774B2

(12) United States Patent
Yanagihara

(10) Patent No.: US 7,567,774 B2
(45) Date of Patent: Jul. 28, 2009

(54) IMAGE FORMING APPARATUS

(75) Inventor: Hirokazu Yanagihara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 230 days.

(21) Appl. No.: 11/761,750

(22) Filed: Jun. 12, 2007

(65) Prior Publication Data

US 2008/0056768 A1 Mar. 6, 2008

(30) Foreign Application Priority Data

Jul. 11, 2006 (JP) ..... 2006-190089

(51) Int. Cl.
*G03G 15/10* (2006.01)

(52) U.S. Cl. ..... 399/237

(58) Field of Classification Search ..... 399/107, 399/237, 238, 239, 246, 127, 128
See application file for complete search history.

(56) References Cited

U.S. PATENT DOCUMENTS 4,222,776 A 9/1980 Tsukada et al.
6,493,530 B2 * 12/2002 Ishii et al. ..... 399/237
7,494,213 B2 * 2/2009 Taniuchi et al. ..... 347/103
7,505,728 B2 * 3/2009 Yamaguchi et al. ..... 399/346

FOREIGN PATENT DOCUMENTS

JP A-S48-074849 10/1973
JP A-11-260686 9/1999
JP A-2004-195788 7/2004

* cited by examiner

*Primary Examiner*—Hoan H Tran
(74) *Attorney, Agent, or Firm*—Oliff & Berridge, PLC

(57) ABSTRACT

An image forming apparatus includes a photosensitive drum having a predetermined rotary shaft, an exposure device conducting exposure on the photosensitive drum so as to form an electrostatic latent image on a surface of the photosensitive drum, a medium supplier that supplies the surface of the photosensitive drum with a liquid material so as to form a layer composed of the liquid material between the exposure device and the photosensitive drum, and a developing device that develops the electrostatic latent image formed on the surface of the photosensitive drum by using a liquid developer containing toner particles.

6 Claims, 5 Drawing Sheets

IMAGE FORMING APPARATUS

BACKGROUND

1. Technical Field

The present invention relates to electrophotographic image forming apparatuses, such as copiers and printers, and particularly, to a wet-type image forming apparatus that develops an electrostatic latent image using a liquid developer, such as liquid toner.

2. Related Art

As an electrophotographic printer, a line printer (image forming apparatus) is known. In a line printer, devices such as a charging device, a line printer head (line head), a developing device, and a transfer device are disposed adjacent to the periphery surface of a photosensitive drum on which exposure is to be conducted. Specifically, the charging device electrically charges the periphery surface of the photosensitive drum, and the line head selectively emits light from light-emitting elements thereof so as to conduct exposure on the periphery surface of the photosensitive drum. Thus, an electrostatic latent image is formed, which is subsequently developed using toner supplied by the developing device so that a toner image is formed. The transfer device then transfers this toner image onto a sheet.

Known light sources of the line head are light-emitting diodes (LED) and organic electroluminescence (EL) elements. In organic EL elements, a solid fluorescent material composed of an organic material is used as a light-emitting layer. Organic EL elements are light-emitting elements that produce light by means of electroluminescence. An organic EL element has an element portion with a thickness of 1 μm or less, and can be formed into a desired shape in accordance with the shape of the substrate. For this reason, organic EL elements are suitable for manufacturing compact line heads.

Since light emitted from an LED or an organic EL element diffuses, an image-formation optical system, like a rod lens array, is necessary to form the image of the light on a photosensitive drum. However, the aperture angle of light in a rod lens array is generally very small, which implies that a rod lens array can transmit light of only a specific angle. Therefore, especially in a case where the light source emits diffused light, the incident efficiency and transmission efficiency of light is extremely low, preventing the efficient use of the light from the light source. In a line head having LED as a light source, forming a desired latent image is possible by emitting an excessive amount of light from the LED. In contrast, in a printer head equipped with organic EL elements, emitting light from the light source by an excessive amount is not preferable since the organic EL elements have a short life. Consequently, in a case where organic EL elements are used as a light source, it is important that the light emitted from the organic EL elements be utilized efficiently.

JP-A-2004-195788 discloses an example of an image forming apparatus in which a light source is disposed inside a photosensitive drum, and the light source and the photosensitive drum have resin therebetween for preventing interfacial reflection. In this configuration, a rear exposure technique is applied in which a section subject to exposure is exposed to light from the inside of the photosensitive drum. This is problematic in view of cost and image quality since the configuration requires special components, such as a transparent base material for the photosensitive drum and transparent electrodes for the electrodes.

SUMMARY

An advantage of some aspects of the invention is that it provides a long-life, high-quality image forming apparatus equipped with a compact printer head, in which a sufficient amount of exposure can be attained without having to emit an excessive amount of light from a light source.

According to an aspect of the invention, an image forming apparatus includes a photosensitive drum having a predetermined rotary shaft, an exposure device conducting exposure on the photosensitive drum so as to form an electrostatic latent image on a surface of the photosensitive drum, a medium supplier that supplies the surface of the photosensitive drum with a liquid material so as to form a layer composed of the liquid material between the exposure device and the photosensitive drum, and a developing device that develops the electrostatic latent image formed on the surface of the photosensitive drum by using a liquid developer containing toner particles.

In this case, the liquid material may be a solvent that is the same as a dispersion medium for the toner particles contained in the liquid developer.

Furthermore, the apparatus may further include a controller that controls the supplying operation of the liquid material by the medium supplier in conjunction with a rotating operation of the photosensitive drum and the exposure operation of the exposure device.

According to another aspect of the invention, an image forming apparatus includes a photosensitive drum having a predetermined rotary shaft, an exposure device conducting exposure on the photosensitive drum so as to form an electrostatic latent image on a surface of the photosensitive drum, a medium supplier that supplies the surface of the photosensitive drum with a refractive-index adjustment medium so as to form an antireflection layer composed of the refractive-index adjustment medium between the exposure device and the photosensitive drum, and a developing device that develops the electrostatic latent image formed on the surface of the photosensitive drum by using a liquid developer containing toner particles.

Accordingly, the antireflection layer formed between the exposure device and the photosensitive drum prevents interfacial reflection at the exposure surface of the exposure device, whereby light from the exposure device can be efficiently supplied onto the photosensitive drum. Thus, a sufficient amount of exposure can be attained without having to emit an excessive amount of light from a light source, thereby contributing to a longer life of the image forming apparatus. Furthermore, the use of a liquid developer as a developer allows for the use of extremely fine submicron-sized toner particles, thereby contributing to an enhanced image quality in the image forming apparatus.

It is preferable that the medium supplier be disposed upstream of the exposure device in a rotating direction of the photosensitive drum.

Accordingly, the antireflection layer can be formed by supplying the refractive-index adjustment medium onto the photosensitive drum and then moving the refractive-index adjustment medium to the exposure surface of the exposure device with the rotation of the photosensitive drum. Thus, the apparatus does not require a complex configuration. This contributes to a size reduction of the image forming apparatus.

It is preferable that the refractive-index adjustment medium be a solvent that is the same as a dispersion medium for the toner particles contained in the liquid developer.

Accordingly, even when the refractive-index adjustment medium is carried to the developing device with the rotation of the photosensitive drum, the refractive-index adjustment medium will not affect the dispersibility of toner particles in the developing device. This prevents the image quality from deteriorating even after a long period of use.

It is preferable that the exposure device include a line head having a plurality of organic electroluminescence elements arranged along the rotary shaft of the photosensitive drum, and a lens array having a plurality of lens elements with which light emitted from the line head is formed into an image on the photosensitive drum.

Accordingly, the use of the organic EL elements as a light source of the exposure device allows for a compact exposure device. In addition, the light emitted from the organic EL elements can be formed into an image by the lens elements, thereby contributing to an efficient use of the light.

It is preferable that the medium supplier include an ejecting device having a slit-shaped ejection hole disposed along the rotary shaft of the photosensitive drum.

In this case, the medium supplier is defined by a simple ejecting device, thereby contributing to further size reduction of the image forming apparatus. In addition, because the ejection hole is disposed longitudinally along the rotary shaft of the photosensitive drum, the refractive-index adjustment medium is distributed uniformly over the outer periphery surface of the photosensitive drum, thereby enhancing the uniformity in the image quality.

It is preferable that the apparatus further include a controller that controls the supplying operation of the refractive-index adjustment medium by the medium supplier in conjunction with a rotating operation of the photosensitive drum and the exposure operation of the exposure device.

Accordingly, this prevents the refractive-index adjustment medium from being wasted and reduces the amount of refractive-index adjustment medium mixed within the developing device, thereby minimizing the effect of variations in toner concentration within the developing device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
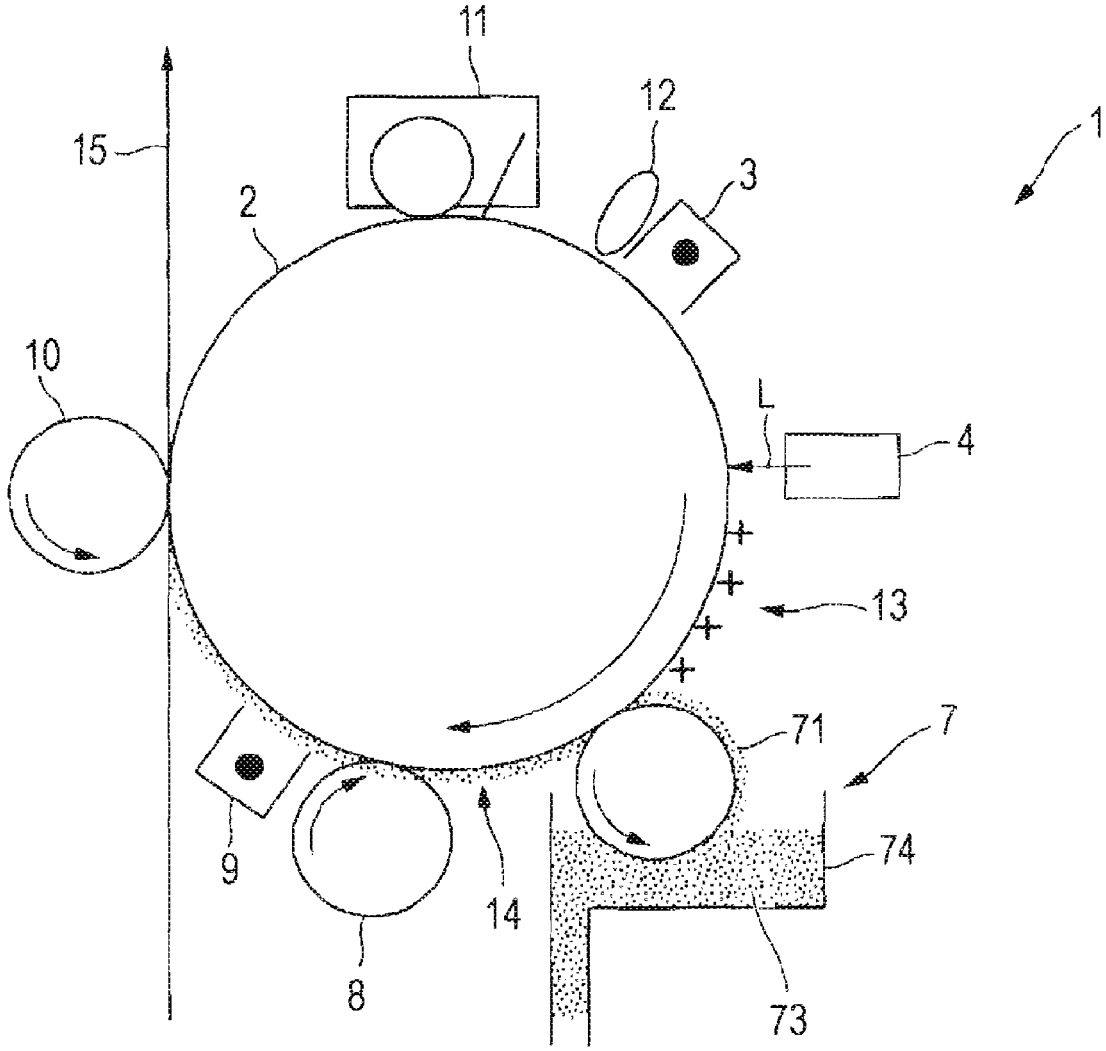
FIG. 1 is a schematic perspective view of an image forming apparatus according to an embodiment of the invention.

An exemplary embodiment of the invention will now be described with reference to the drawings. To provide easier understanding of the drawings, the ratios of the film thicknesses and dimensions of the components in the drawings are shown differently from the actual values.

FIG. 1 is a schematic perspective view of an image forming apparatus 1 according to an embodiment of the invention. The image forming apparatus 1 includes a photosensitive drum 2 serving as an image carrier disposed adjacent to a transport path of a transfer medium 15. The image forming apparatus 1 also includes a charging device 3, an exposure unit 4, a developing device 7, a squeezing device 8, a set corona device 9, a transfer roller 10, a cleaning device 11, and a discharging device 12, which are disposed in that order around the photosensitive drum 2 in a rotating direction thereof, as indicated with an arrow. The transfer roller 10 is disposed opposite to the photosensitive drum 2 across the transport path of the transfer medium 15 such that the transfer roller 10 and the photosensitive drum 2 can nip the transfer medium 15 therebetween.

As the photosensitive drum 2 rotates in the image forming apparatus 1, the surface of the photosensitive drum 2, i.e. the photosensitive surface, is positively charged by the charging device 3. The exposure unit 4 then forms an electrostatic latent image 13 on the surface of the photosensitive drum 2 by exposure. Subsequently, a developing roller 71 included in the developing device 7 supplies the surface of the photosensitive drum 2 with a liquid toner 73, i.e. liquid developer, contained in a liquid container 74. Due to electric absorbability of the electrostatic latent image 13, a toner image 14 that corresponds to the electrostatic latent image 13 is formed. The liquid toner 73 is of a type that has toner particles charged to a specific polarity dispersed within an insulative solvent. In this case, the toner particles are positively charged.

After the toner image 14 is formed by the developing device 7, the squeezing device 8 removes excess insulative solvent from the toner image 14. The set corona device 9 then gives the toner image 14 an electric charge of the same polarity as the toner particles so as to enhance the cohesion force of the toner particles. When the toner image 14 comes into contact with the transfer medium 15 as a result of further rotation of the photosensitive drum 2, the transfer roller 10 gives the transfer medium 15 an electric charge of a polarity opposite to that of the toner particles of the toner image 14 (in this case, a negative electric charge) from the rear face of the transfer medium 15. Thus, the toner particles constituting the toner image 14 are drawn from the surface of the photosensitive drum 2 towards the transfer medium 15, whereby the toner image 14 is transferred to the surface of the transfer medium 15. Subsequently, the cleaning device 11 removes the toner particles remaining on the surface of the photosensitive drum 2, and the discharging device 12 removes the electric charge remaining on the surface of the photosensitive drum 2.

The image forming apparatus 1 shown in FIG. 1 is an image forming apparatus for monochrome printing. The color used for printing depends on the color of toner particles included in the liquid toner 73. On the other hand, when multicolor printing is to be performed, a plurality of image forming apparatuses is arranged along the transport path of the transfer medium 15 such that the number of image forming apparatuses corresponds to the number of print colors.

Figure 2:
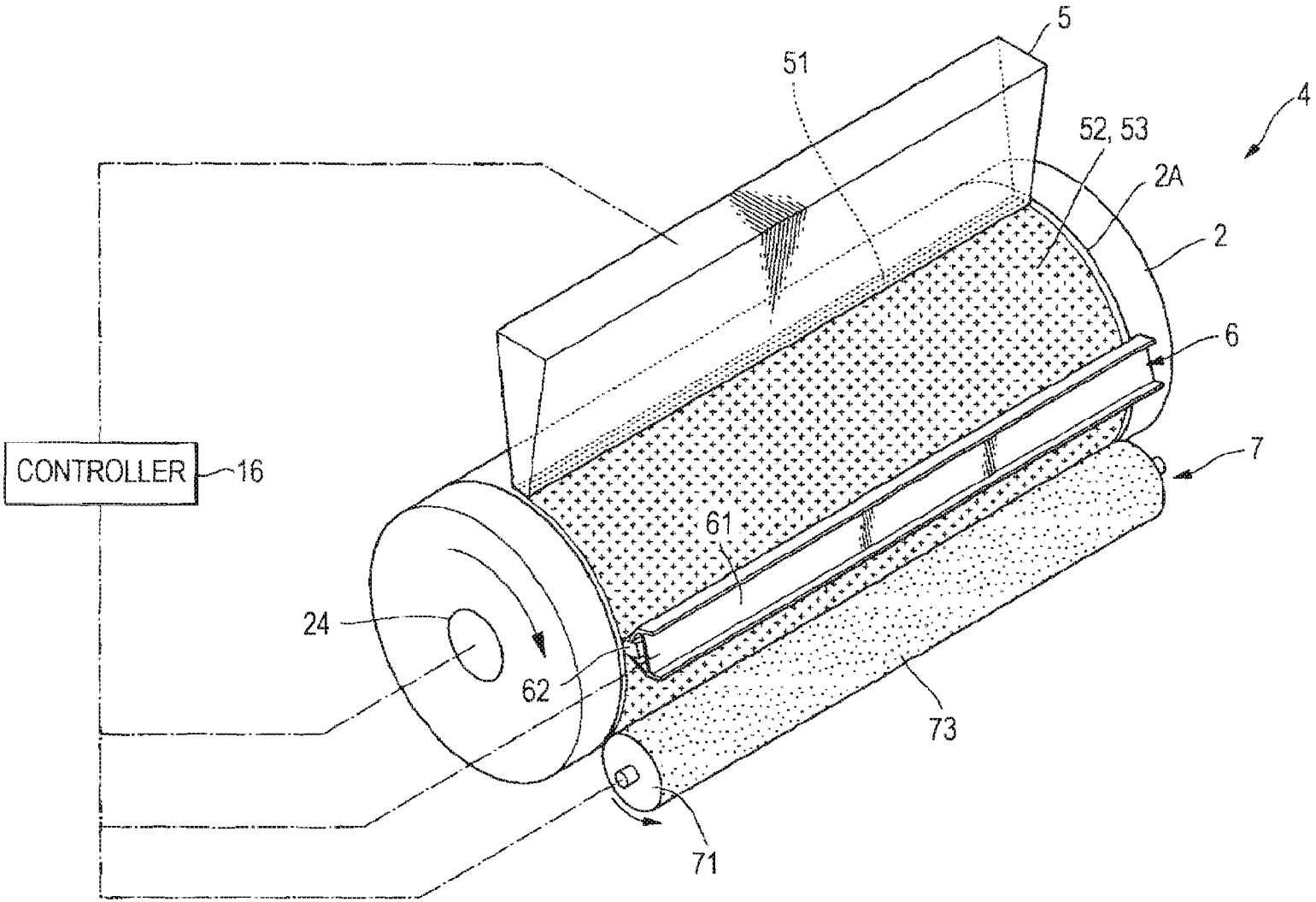
FIG. 2 is a partial perspective view of the image forming apparatus that includes an exposure device.

FIG. 2 is a perspective view showing a relevant portion of the image forming apparatus that includes the exposure unit 4. The exposure unit 4 includes an ejecting device 5 serving as a medium supplier of a refractive-index adjustment medium, and an exposure device 6, which are arranged in the rotating direction of the photosensitive drum 2. The photosensitive drum 2 is rotatably disposed around a rotary shaft 24. In the direction in which the rotary shaft extends, the midsection in the outer periphery surface of the photosensitive drum 2 is provided with a photosensitive surface 2A. The ejecting device 5 and the exposure device 6 are arranged longitudinally along the rotary shaft 24 of the photosensitive drum 2. The widths of the ejecting device 5 and the exposure device 6 in the longitudinal direction are substantially the same as the width of the photosensitive surface 2A.

The ejecting device 5 has a slit-shaped ejection hole 51 disposed along the rotary shaft 24 of the photosensitive drum 2. Through this ejection hole 51, a transparent liquid material 52 as a refractive-index adjustment medium is ejected onto the photosensitive drum 2. The transparent liquid material 52 is an insulative solvent capable of dispersing the toner particles. In this case, the same solvent as the insulative solvent contained in the liquid toner 73 is used. The transparent liquid material 52 is supplied to the surface of the photosensitive drum 2 so as to form an antireflection layer between the photosensitive drum 2 and the exposure device 6. The antireflection layer prevents interfacial reflection at an exposure surface of the exposure device 6.

Figure 3:
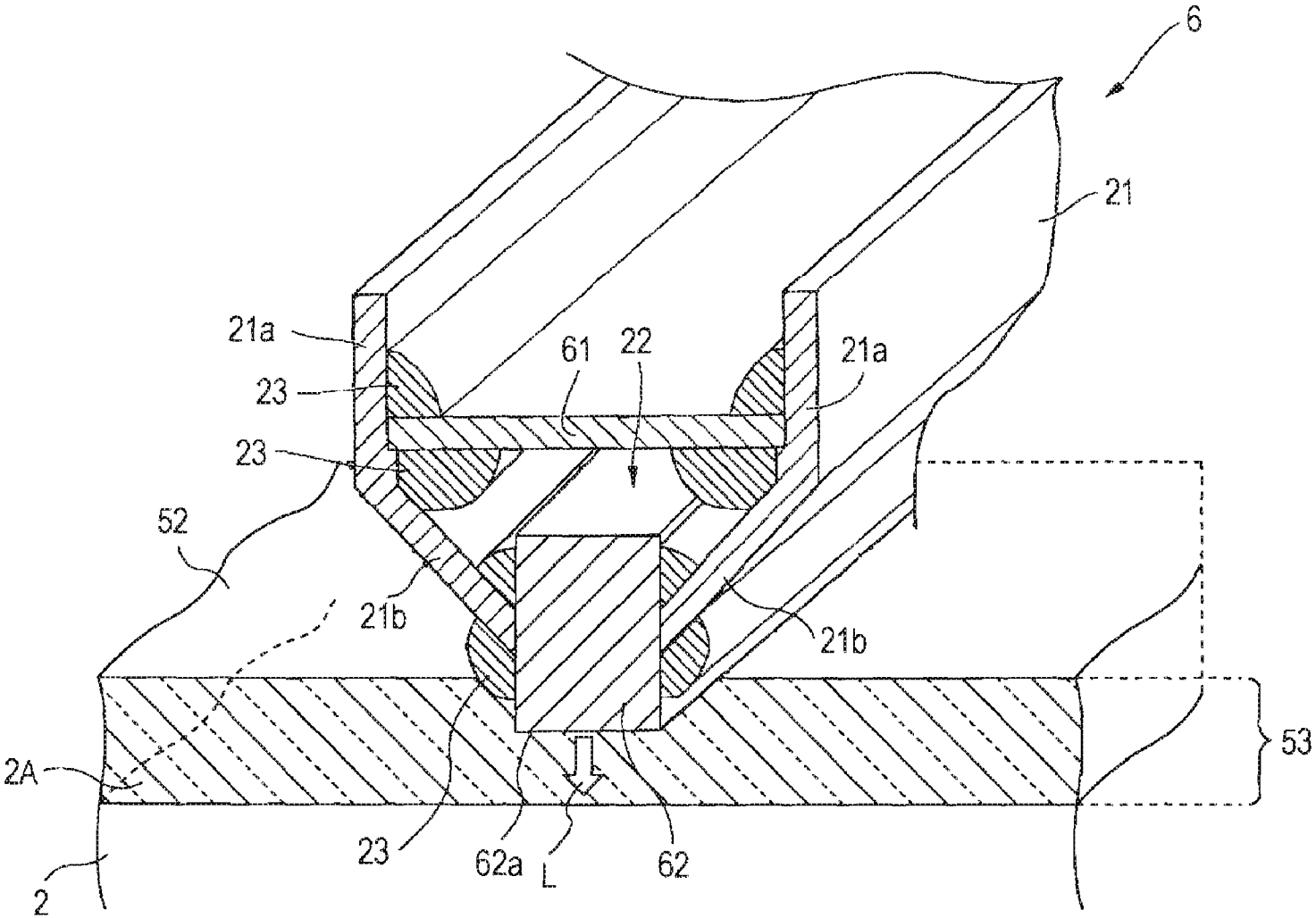
FIG. 3 is a perspective cross-sectional view of the exposure device.

FIG. 3 is a perspective cross-sectional view showing an area near the photosensitive drum 2 that includes the exposure device 6. The exposure device 6 includes a line head 61 having a plurality of organic electroluminescence (EL) elements arranged along the rotary shaft of the photosensitive drum 2, a lens array 62 having a plurality of lens elements arranged along the rotary shaft of the photosensitive drum 2, and a head casing 21 that supports the outer peripheries of the line head 61 and the lens array 62. The plurality of lens elements included in the lens array 62 is for allowing the light emitted from the line head 61 to form an erected unmagnified image.

Figure 4:
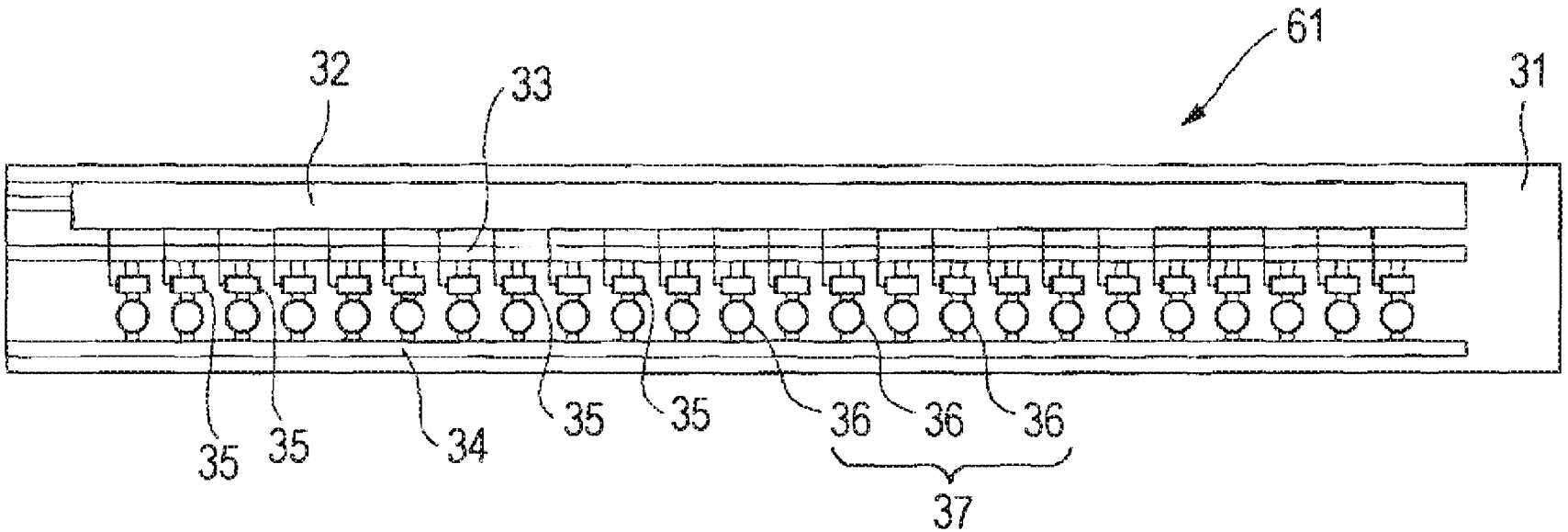
FIG. 4 is a plan view showing a line head of the exposure device.

FIG. 4 is a plan view of the line head 61. The line head 61 has a long rectangular element substrate 31 which is integrally provided thereon with a light-emitting element array 37 constituted by an array of a plurality of organic EL elements 36, a driving-element array constituted by driving elements 35 for driving the organic EL elements 36, and a control circuit group 32 for controlling the driving of the driving elements 35, i.e. the driving-element array. Although the light-emitting element array 37 is constituted by one array of the organic EL elements 36 in FIG. 4, the organic EL elements 36 may alternatively be arranged in two arrays in a zigzag pattern.

Each organic EL element 36 includes at least an organic light-emitting layer between a pair of electrodes. The light-emitting layer receives electric current from the pair of electrodes so as to emit light. One of the electrodes in each organic EL element 36 is connected to a power supply line 34, while the other electrode is connected to a power supply line 33 through the corresponding driving element 35. Each driving element 35 is a switching element, such as a thin film transistor (TFT) and a thin film diode (TFD). If TFTs are used as the driving elements 35, the source regions of the TFTs are connected to the power supply line 34, and the gate electrodes thereof are connected to the control circuit group 32. The control circuit group 32 controls the operation of the driving elements 35, whereby the driving elements 35 control power distribution to the organic EL elements 36.

Figure 5:
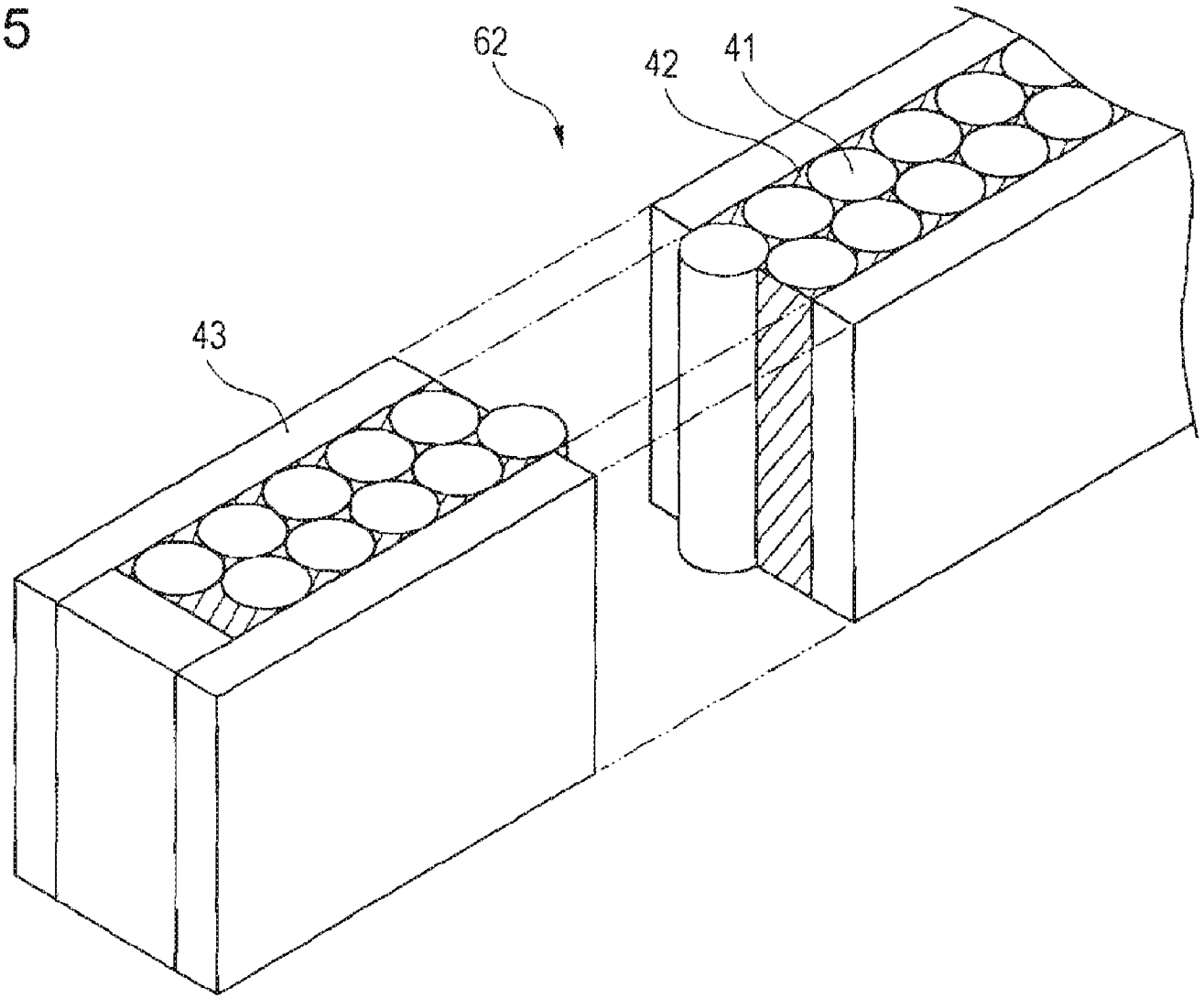
FIG. 5 is a partial perspective view showing a lens array of the exposure device.

FIG. 5 is a partial perspective view of the lens array 62. The lens array 62 includes lens elements 41 arranged in two arrays in a zigzag pattern. These lens elements 41 have a similar configuration to the SELFOC (registered trademark) lens elements manufactured by Nippon Sheet Glass Co., Ltd. The SELFOC (registered trademark) lens elements each have a fibrous shape with a diameter of about 0.56 mm at minimum. On the other hand, the lens elements 41 in this embodiment each have a diameter of 0.3 mm or less, and more preferably, 0.28 mm or less. Furthermore, the spaces between the lens elements 41 arranged in a zigzag pattern are filled with black silicon resin 42, and moreover, a frame 43 is disposed surrounding the lens elements 41.

The lens elements 41 each have a parabolic refractive-index distribution from the center towards the periphery thereof. For this reason, light incident on each lens element 41 travels in a zigzag manner at a constant frequency through the interior thereof. Consequently, by adjusting the length of the lens elements 41, an image can be formed in an erected unmagnified fashion. In these lens elements 41 that are capable of forming an erected unmagnified image, images formed by adjacent lens elements 41 can be superimposed, whereby an image of a wide range can be attained. Accordingly, the lens array 62 shown in FIG. 5 can produce an image of the light from the entire line head 61 with high precision.

Referring to FIG. 3, the line head 61 and the lens array 62 are supported by the head casing 21 in a state where the line head 61 and the lens array 62 are aligned with each other. The head casing 21 has a slit-like structure composed of a rigid material such as aluminum. In a cross section of the head casing 21 taken along a line extending perpendicular to the longitudinal direction thereof, the upper and lower sides of the head casing 21 are given openings. The upper half of the head casing 21 has sidewalls 21*a*, 21*a* that are parallel to each other, whereas the lower half has sidewalls 21*b*, 21*b* that extend slantwise towards the center of the lower side. The upper sidewalls 21*a* of the head casing 21 have the line head 61 disposed therein. The slit-shaped opening at the lower side of the head casing 21 has the lens array 62 disposed therein.

The sidewalls 21*a* of the head casing 21 and the line head 61 form corner sections therebetween. A sealing material 23 is disposed in these corner sections along the entire circumference thereof. Similarly, the sidewalls 21*b* of the head casing 21 and the lens array 62 also form corner sections therebetween, which have a sealing material 23 disposed therein along the entire circumference thereof. Consequently, the line head 61 and the lens array 62 are hermetically bonded to the head casing 21. The line head 61 and the lens array 62 within the head casing 21 have a chamber 22 therebetween. The chamber 22 is hermetically sealed, and the interior thereof is filled with an inert gas, such as nitrogen gas, or is maintained in a vacuum.

Referring to FIG. 3, light emitted from the line head 61 is formed into an image on the photosensitive surface 2A of the photosensitive drum 2 by the lens array 62. The transparent liquid material 52, serving as a refractive-index adjustment medium supplied by the ejecting device 5 in FIG. 2, intervenes an exit surface (exposure surface) 62*a* of the lens array 62 and the photosensitive surface 2A of the photosensitive drum 2 so as to form an antireflection layer 53. The transparent liquid material 52 used is a liquid material whose difference in refractive index with the exposure surface 62*a* of the lens array 62 is smaller than that with air. For example, the difference in refractive index is adjusted to 0.2 or less. Consequently, light emitted from the lens array 62 is supplied onto the photosensitive drum 2 without being reflected at the interface between the exposure surface 62*a* and the antireflection layer 53.

The transparent liquid material 52 is carried to the developing device with the rotation of the photosensitive drum 2, and is partly mixed into the liquid container of the developing device. Because the transparent liquid material 52 is composed of the same solvent as the insulative solvent for dispersing the toner particles, the transparent liquid material 52 will not affect the dispersibility of toner particles within the liquid container.

Referring to FIG. 2, the ejecting device 5, the photosensitive drum 2, the exposure device 6, and the developing device 7 are controlled by a controller 16. The controller 16 controls the supplying operation of the transparent liquid material 52 by the ejecting device 5 in conjunction with the rotating operation of the photosensitive drum 2, the exposure operation of the exposure device 6, and the rotating operation of the developing roller 71 in the developing device 7. Accordingly, this prevents the transparent liquid material 52 from being wasted and reduces the amount of transparent liquid material 52 mixed within the liquid container, thereby minimizing the effect of variations in toner concentration within the liquid container.

Accordingly, in the image forming apparatus 1 of this embodiment, the antireflection layer 53 formed between the line head 61 and the photosensitive drum 2 prevents interfacial reflection at the exposure surface of the line head 61, whereby light from the line head 61 can be efficiently supplied onto the photosensitive drum 2. Thus, a sufficient amount of exposure can be attained without having to emit an excessive amount of light from a light source, thereby contributing to a longer life of the image forming apparatus 1. In addition, since the antireflection layer 53 is formed by supplying the transparent liquid material 52 onto the photosensitive drum 2 and then moving the transparent liquid material 52 to the exposure surface 62*a* of the line head 61 with the rotation of the photosensitive drum 2, the apparatus does not require a complex configuration. This contributes to a size reduction of the image forming apparatus 1. Furthermore, the use of a liquid developer, i.e. liquid toner 73, as a developer allows for the use of extremely fine submicron-sized toner particles, thereby contributing to an enhanced image quality in the image forming apparatus 1. In addition, because the transparent liquid material 52 is composed of the same solvent as the dispersion medium for the toner particles contained in the liquid toner 73, even if the transparent liquid material 52 is carried to the developing device 7 with the rotation of the photosensitive drum 2, the transparent liquid material 52 will not affect the dispersibility of toner particles in the developing device 7. This prevents the image quality from deteriorating even after a long period of use.

In this embodiment, the same solvent as the insulative solvent contained in the liquid toner 73 is used as a refractive-index adjustment medium. However, the refractive-index adjustment medium does not necessary need to be the same solvent as the insulative solvent contained in the liquid toner 73. Other dispersion media are permissible as long as they are capable of dispersing the toner particles. Furthermore, media other than such dispersion media are also permissible as long as they do not affect the dispersibility of the toner particles. Although the medium supplier is defined by an ejecting device equipped with a long ejection hole, the medium supplier is not limited to this type.

Although an exemplary embodiment of the invention has been described above with reference to the drawings, it is apparent that the invention is not limited to the above embodiment. The shapes and combinations of the components described in the above embodiment are only examples, and various modifications may occur depending on design requirements and other factors as they do not depart from the scope of the invention.

The entire disclosure of Japanese Patent Application No. 2006-190089, filed Jul. 11, 2006 is expressly incorporated by reference herein.

What is claimed is:

1. An image forming apparatus comprising:

a photosensitive drum having a predetermined rotary shaft;

an exposure device conducting exposure on the photosensitive drum so as to form an electrostatic latent image on a surface of the photosensitive drum;

a medium supplier that supplies the surface of the photosensitive drum with a liquid material so as to form a layer composed of the liquid material between the exposure device and the photosensitive drum; and a developing device that develops the electrostatic latent image formed on the surface of the photosensitive drum by using a liquid developer containing toner particles.

2. The image forming apparatus according to claim 1, wherein the liquid material is a solvent that is the same as a dispersion medium for the toner particles contained in the liquid developer.

3. The image forming apparatus according to claim 1, wherein the medium supplier is disposed upstream of the exposure device in a rotating direction of the photosensitive drum.

4. The image forming apparatus according to claim 1, wherein the exposure device includes a line head having a plurality of organic electroluminescence elements arranged along the rotary shaft of the photosensitive drum, and a lens array having a plurality of lens elements with which light emitted from the line head is formed into an image on the photosensitive drum.

5. The image forming apparatus according to claim 1, wherein the medium supplier includes an ejecting device having a slit-shaped ejection hole disposed along the rotary shaft of the photosensitive drum.

6. The image forming apparatus according to claim 1, further comprising a controller that controls the supplying operation of the liquid material by the medium supplier in conjunction with a rotating operation of the photosensitive drum and the exposure operation of the exposure device.

* * * * *